US007744350B2

(12) United States Patent
Ogino et al.

(10) Patent No.: US 7,744,350 B2
(45) Date of Patent: Jun. 29, 2010

(54) MULTIBLADE FAN

(75) Inventors: Kazuo Ogino, Aichi (JP); Kazuya Omori, Hiroshima (JP)

(73) Assignee: Panasonic Corporation, Osaka (JP)

( * ) Notice: Subject to any disclaimer, the term of this patent is extended or adjusted under 35 U.S.C. 154(b) by 601 days.

(21) Appl. No.: 11/574,774

(22) PCT Filed: Dec. 13, 2004

(86) PCT No.: PCT/JP2004/018551

§ 371 (c)(1),
(2), (4) Date: Mar. 6, 2007

(87) PCT Pub. No.: WO2006/030542

PCT Pub. Date: Mar. 23, 2006

(65) Prior Publication Data

US 2007/0253834 A1 Nov. 1, 2007

(30) Foreign Application Priority Data

Sep. 13, 2004 (JP) ..... 2004-265142

(51) Int. Cl.
*F01D 5/14* (2006.01)

(52) U.S. Cl. ..... 416/178; 416/187; 416/223 B; 415/206

(58) Field of Classification Search ..... 415/119, 415/206, 204, 53.1; 416/223 B, 178, 228, 416/248, 175, 203, 187, 186 R, 235, 237
See application file for complete search history.

(56) References Cited

U.S. PATENT DOCUMENTS 5,064,346 A * 11/1991 Atarashi et al. ..... 416/178
5,564,495 A * 10/1996 Yoshihashi et al. ..... 416/178
6,604,906 B2 * 8/2003 Ozeki et al. ..... 416/186 R

FOREIGN PATENT DOCUMENTS

| | | | |
|---|---|---|---|
| GB | 741797 | | 12/1955 |
| JP | 60156997 | A * | 8/1985 |
| JP | 05-126097 | | 5/1993 |
| JP | 07-247999 | | 9/1995 |
| JP | 2000-009094 | | 1/2000 |
| JP | 2000-257590 | | 9/2000 |
| JP | 2001-280291 | | 10/2001 |
| JP | 2002-168194 | | 6/2002 |
| JP | 2002-364591 | | 12/2002 |

OTHER PUBLICATIONS

International Search Report for application No. PCT/JP2004/018551 dated Mar. 29, 2005.

* cited by examiner

*Primary Examiner*—Richard Edgar
(74) *Attorney, Agent, or Firm*—RatnerPrestia

(57) ABSTRACT

A multi-blade fan includes a spirally-shaped housing which has a bell-mouth orifice on one side, a sucking inlet and an exhausting outlet, an impeller which is placed in a housing and has a plurality of blades supported by a main plate and a lateral plate at both the axial ends, and a motor for driving the impeller. A cross section, cut along vertically with respect to a rotary shaft of the impeller, of each one of the blades has a given shape which allows a main air stream to flow along a back face of each one of blades.

16 Claims, 10 Drawing Sheets

MULTIBLADE FAN

This Application is a U.S. National Phase Application of PCT International Application PCT/JP04/018551.

TECHNICAL FIELD

The present invention relates to multi-blade fans to be used in ventilating blowers, air-conditioners, dehumidifiers, humidifiers, air-cleaners and so on.

BACKGROUND ART

Conventional multi-blade fans used in homes or offices are disclosed in, e.g. Unexamined Japanese Patent Publication No. 2002-168194. One of these conventional multi-blade fans is described hereinafter with reference to FIG. 12 and FIG. 13.

FIG. 12 shows a general view of a conventional multi-blade fan, of which spirally-shaped housing 1 has bell-mouth orifice 2 on the upper side at the center. Housing 1 also has sucking inlet 3 and exhausting outlet 4. Housing 1 includes impeller 5 therein, which is driven by motor 6. Impeller 5 has a number of blades 9 supported by main plate 7 and lateral plate 8 at both the axial ends of respective blades. Air sucked from inlet 3 works as inflow stream 10 as the arrow mark in FIG. 12 shows and is guided to impeller 5.

FIG. 13 shows a sectional view cut along the direction vertical with respect to the rotary shaft of blades 9. A number of blades 9 in identical shape are annularly arranged at equal intervals. Each one of blades 9 shapes like as shown in FIG. 13, and has leading edge 11, trailing edge 12, and protrusion 14 on back face 13.

The air guided by orifice 2 flows like inflow stream 10 and exhausting stream 15 marked with the arrow marks. Separation vortices from back face 13 are suppressed by protrusion 14, thereby generating smaller vortices, which lower turbulent noise.

In the conventional multi-blade fan, however, blades 9 of impeller 5 still generate large vortices, so that the noise generated by impeller 5 is not yet satisfactorily suppressed, and needs to be lowered.

DISCLOSURE OF INVENTION

The present invention addresses the problem discussed above, and aims to provide a multi-blade fan generating lower noise. The multi-blade fan of the present invention thus comprises the following elements:

- a spirally-shaped housing having a bell-mouth orifice at one side, a sucking inlet, and an exhausting outlet;
- an impeller placed in the housing and having a plurality of blades which are supported by a main plate and a lateral plate at both the axial ends of respective blades; and
- a motor for driving the impeller.

Each one of the blades has a cross section cut in a given length along the direction vertical with respect to its rotary shaft, which cross section shows a given shape, which allows a main air stream to flow along a back face of the blade.

The foregoing structure allows the multi-blade fan of the present invention to suppress the separation vortices generated on the back face of the blade, thereby lowering the noise to be radiated outside.

DESCRIPTION OF REFERENCE MARKS

Figure 1:
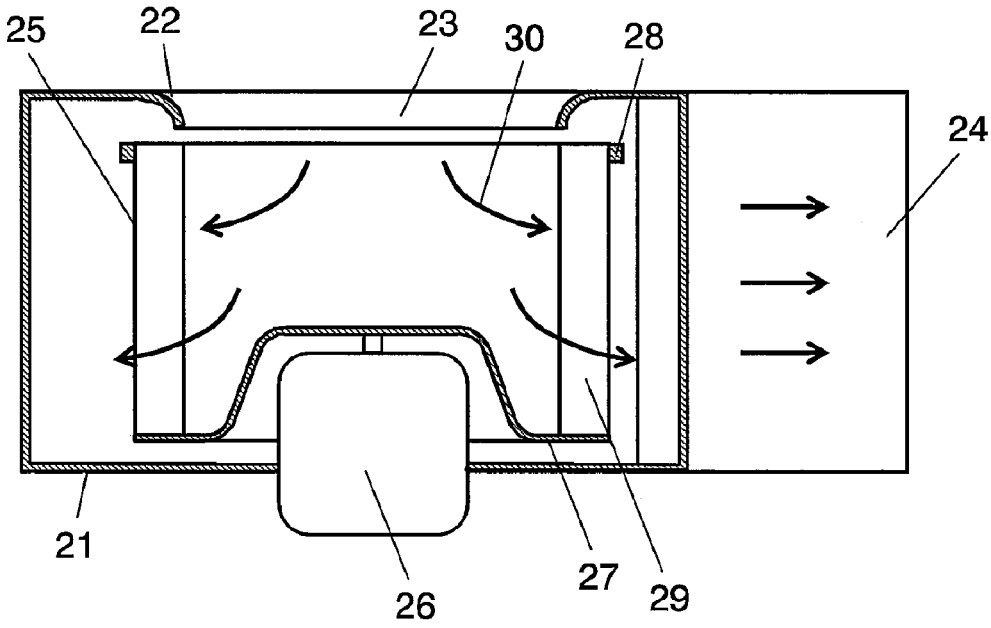
FIG. 1 shows a general view of a multi-blade fan in accordance with a first embodiment of the present invention.

21 housing
22 orifice
23 sucking inlet
24 exhausting outlet
25, 25*a*, 25*b*, 25*c*, 25*d*, 25*e*, 25*f*, 25*g* impeller
26 motor
27 main plate
28 lateral plate
29, 29*a*, 29*b*, 29*c*, 29*d*, 29*e*, 29*f*, 29*g* blade
31, 31*a*, 31*b*, 31*c*, 31*d*, 31*e*, 31*f*, 31*g* leading edge
32, 32*a*, 32*b*, 32*c*, 32*d*, 32*e*, 32*f*, 32*g* trailing edge
33, 33*a*, 33*b*, 33*c*, 33*d*, 33*e*, 33*f*, 33*g* back face
36, 36*a*, 36*b*, 36*c*, 36*d*, 36*e*, 36*f*, 36*g* thin walled section
37, 37*a*, 37*b*, 37*c*, 37*d*, 37*e*, 37*f*, 37*g* thick walled section
38, 38*a*, 38*b*, 38*c*, 38*d*, 38*e*, 38*f*, 38*g* junction
40 first orifice
41, 44 second orifice

PREFERRED EMBODIMENTS OF INVENTION

Exemplary embodiments of the present invention are demonstrated hereinafter with reference to the accompanying drawings.

Embodiment 1

FIG. 1 shows a general view of a multi-blade fan in accordance with the first embodiment of the present invention. Spirally-shaped housing 21 has bell-mouth orifice 22 on the upper side at the center, sucking inlet 23, and exhausting outlet 24. Housing 21 includes impeller 25 therein, which is driven by motor 26. Impeller 25 has a number of blades 29 supported by main plate 27 and lateral plate 28 at both the axial ends of respective blades. Air sucked from inlet 23 works as inflow stream 30 and guides the air supplied to impeller 25 along the arrow marks shown in FIG. 1.

Figure 2:
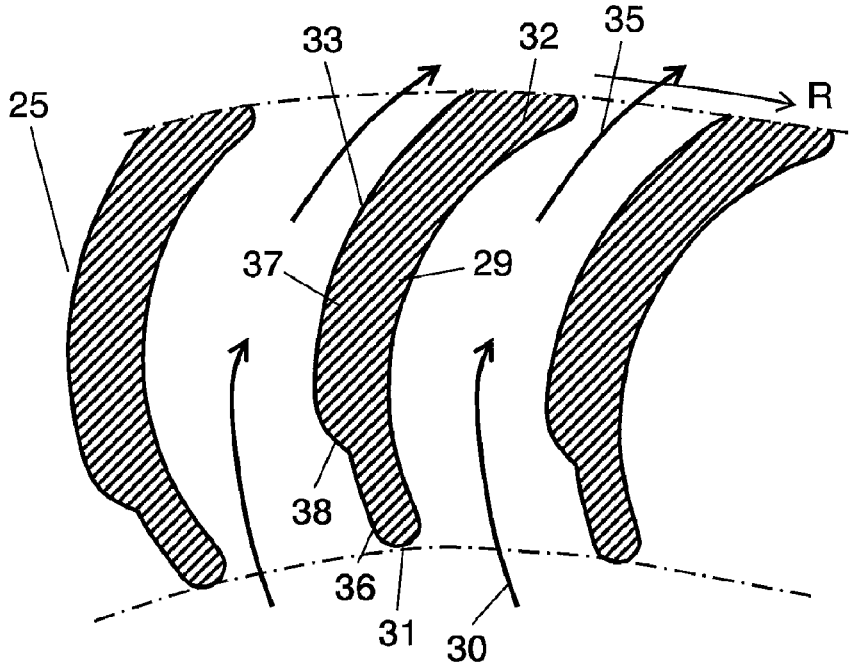
FIG. 2 shows a sectional view cut along the vertical direction with respect to the rotary shaft of the blades of the multi-blade fan shown in FIG. 1.

FIG. 2 shows a sectional view cut along the direction vertical with respect to the rotary shaft of blades 29 of the multi-blade fan shown in FIG. 1. A number of blades 29 in identical shape are annularly arranged at equal intervals. Each one of blades 9 shapes like as shown in FIG. 2, and has leading edge 31, trailing edge 32, back face 33 each of which are in given shapes.

The air guided by orifice 22 flows along inflow stream 30 and exhausting stream 35 marked with the arrow marks. Separation vortices at back face 33 are suppressed by the given shape of back face 33, thereby generating smaller vortices, which reduce turbulent noise.

Next, the shape of respective blades 29 is detailed hereinafter. Motor 26 drives impeller 25 to rotate along arrow mark R, then airflow along back face 33 of blade 29 separates from the midway of blade 29. Separation vortices grow greater as the airflow approaches to the outer periphery, and grows to the maximum size at an exhausting outlet of blade 29, so that generated turbulent noise tends to become loud.

However, back face 33 of blade 29 is shaped in a given contour so that the main air-stream can flow from leading edge 31 toward trailing edge 32 along back face 33 of blade 29. To be more specific, a cross section of back face 33 cut along the direction vertical with respect to the rotary shaft of blade 29 has the given contour, namely, the contour includes thin-walled section 36 and thick-walled section 37 from leading edge 31 to trailing edge 32.

The thickness of thin-walled section 36 is not less than 1/10 (one tenth, or 10%) that of thick-walled section 37 and not greater than ½ (one half, or 50%) thereof. The length of thin-walled section 36 is not shorter than 1/20 and not longer than ⅓ of the chord length. Junction 38 between thin-walled section 36 and thick-walled section 37 shapes like an arc, and the length of junction 38 is not shorter than 1/20 and not longer than 1/10 of the chord length. The arc-shaped junction 38 preferably has a contour that assists section 36 to change rather sharply over to section 37.

The shape discussed above allows suppressing the separation of airflow from back face 33, so that vortices separating from back face 33 become smaller. The reason why thick-walled section 37 is placed at a distance from leading edge 31 is that the separation vortices occur at a place some few distance away from leading edge 31. If the thickness of thick-walled section 37 is too thick, intervals between adjacent blades become smaller, while if it is too thin, the expected advantage cannot be produced. The foregoing range is thus optimum. As a result, separation vortices at blade 29 are reduced, so that the noise generated by the impeller can be lowered.

Embodiment 2

Figure 3:
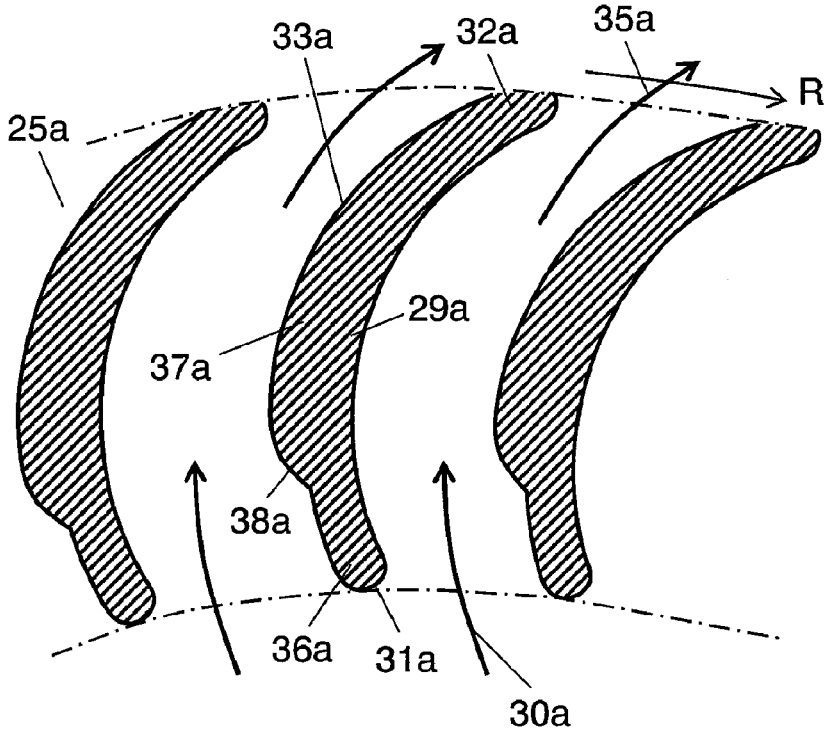
FIG. 3 shows a sectional view cut along the vertical direction with respect to the rotary shaft of the blades of the multi-blade fan in accordance with a second embodiment of the present invention.

FIG. 3 shows a sectional view cut along the direction vertical with respect to the rotary shaft of blade 29*a* of the multi-blade fan in accordance with the second embodiment of the present invention. Elements similar to those in the first embodiment have the same reference marks, and the detailed descriptions thereof are omitted here.

The air guided by orifice 22 flows along inflow stream 30*a* and exhausting stream 35*a* marked with the arrow marks. Separation vortices at back face 33*a* are suppressed by the given shape of back face 33*a*, thereby generating smaller vortices, which lower turbulent noise.

As shown in FIG. 3, back face 33*a* of blade 29*a* is shaped in a given contour so that the main air stream can flow from leading edge 31*a* toward trailing edge 32*a* along back face 33*a* of blade 29*a*. To be more specific, a cross section of back face 33*a* cut along the direction vertical with respect to the rotary shaft of blade 29*a* has the given contour, namely, the contour includes thin-walled section 36*a* and thick-walled section 37*a*, which tapers, i.e. becomes thinner, toward trailing edge 32*a*. The thickness of trailing edge 32*a* is about a half of the thickness around junction 38*a*.

The thickness of thin-walled section 36*a* is not less than 1/10 of the max. thickness of thick-walled section 37*a* and not greater than ½ thereof. The length of thin-walled section 36*a* is not shorter than 1/20 and not longer than ⅓ of the chord length. Junction 38*a* between thin-walled section 36*a* and thick-walled section 37*a* shapes like an arc, and the length of junction 38*a* is not shorter than 1/20 and not longer than 1/10 of the chord length. The arc-shaped junction 38*a* preferably has a contour that assists section 36*a* to change rather sharply over to section 37*a*.

In this second embodiment, back face 33*a* has a cross section cut along the direction vertical with respect to the rotary shaft of blade 29*a*, and the cross section changes in its thickness firstly thicker then thinner gradually from leading edge 31*a* toward trailing edge 32*a*. This structure suppresses the separation of the airflow from the back face, and allows the airflow to flow smoothly toward the trailing edge. The reason why thick-walled section 37*a* is placed at a distance from leading edge 31*a* is that the separation vortices occur at a place some few distance away from leading edge 31*a*. If the thickness of thick-walled section 37*a* is too thick, intervals between adjacent blades become smaller, while if it is too thin, the expected advantage cannot be produced.

The main air stream, in general, encounters greater separation vortices at a some few distance away from the inlet, and then the vortices gradually become smaller. The thickness tapers toward the outlet in accordance with this mechanism, thus the main air stream is not hindered and can be efficiently guided to the outlet. As a result, the separation vortices from blade 29*a* become smaller, so that the noise generated by the impeller can be lowered.

Embodiment 3

Figure 4:
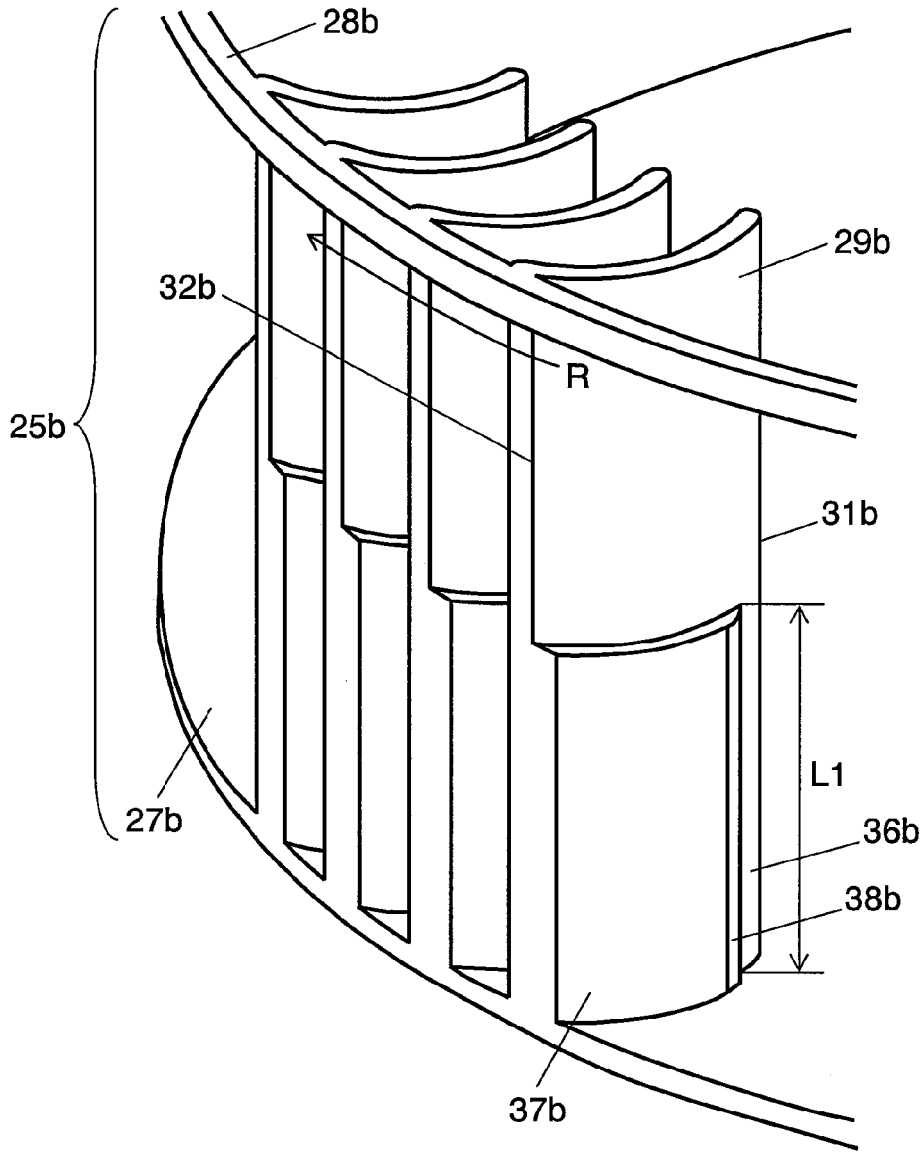
FIG. 4 shows a perspective view illustrating a main part of a multi-blade fan in accordance with a third embodiment of the present invention.

FIG. 4 shows a perspective view illustrating a main part of a multi-blade fan in accordance with the third embodiment of the present invention. Elements similar to those in the first and the second embodiments have the same reference marks, and the detailed descriptions thereof are omitted here.

As shown in FIG. 4, impeller 25*b* includes a number of blades 29*b* supported by main plate 27*b* and lateral plate 28*b* at both the axial ends of each one of blades 29*b*, which are formed in a given shape within given length L1 axially from main plate 27*b*. Length L1 falls within a range from not shorter than ⅓ to not longer than ⅔ of the entire axial length of blade 29*b*.

The given shape within given length L1 is similar to that of the first embodiment; a contour of the back face includes thin-walled section 36*b* and thick-walled section 37*b* from leading edge 31*b* to trailing edge 32*b*. The thickness of thin-walled section 36*b* is not less than 1/10 that of thick-walled section 37*b* and not greater than ½ thereof. The length of thin-walled section 36*b* is not shorter than 1/20 and not longer than ⅓ of the chord length. Junction 38*b* between thin-walled section 36*b* and thick-walled section 37*b* shapes like an arc, and the length of junction 38*b* is not shorter than 1/20 and not longer than 1/10 of the chord length. The arc-shaped junction 38*b* preferably has a contour that assists section 36*b* to change rather sharply over to section 37*b*.

The foregoing shape of blade 29*b* allows suppressing the separation of airflow from the lateral-face and the back-face of main plate 27*b* when the airflow gathers on main plate 27*b*, i.e. at a greater airflow volume time. The reason why thick-walled section 37*b* is placed at a distance from leading edge 31*b* is that the separation vortices occur at a place some few distance away from leading edge 31*b*. If the thickness of thick-walled section 37*b* is too thick, intervals between adjacent blades become smaller, while if it is too thin, the expected advantage cannot be produced.

The foregoing structure allows the airflow around the back face to flow along blade 29*b* efficiently, so that the separation vortices can be suppressed, thus the noise generated by the impeller can be lowered.

Embodiment 4

Figure 5:
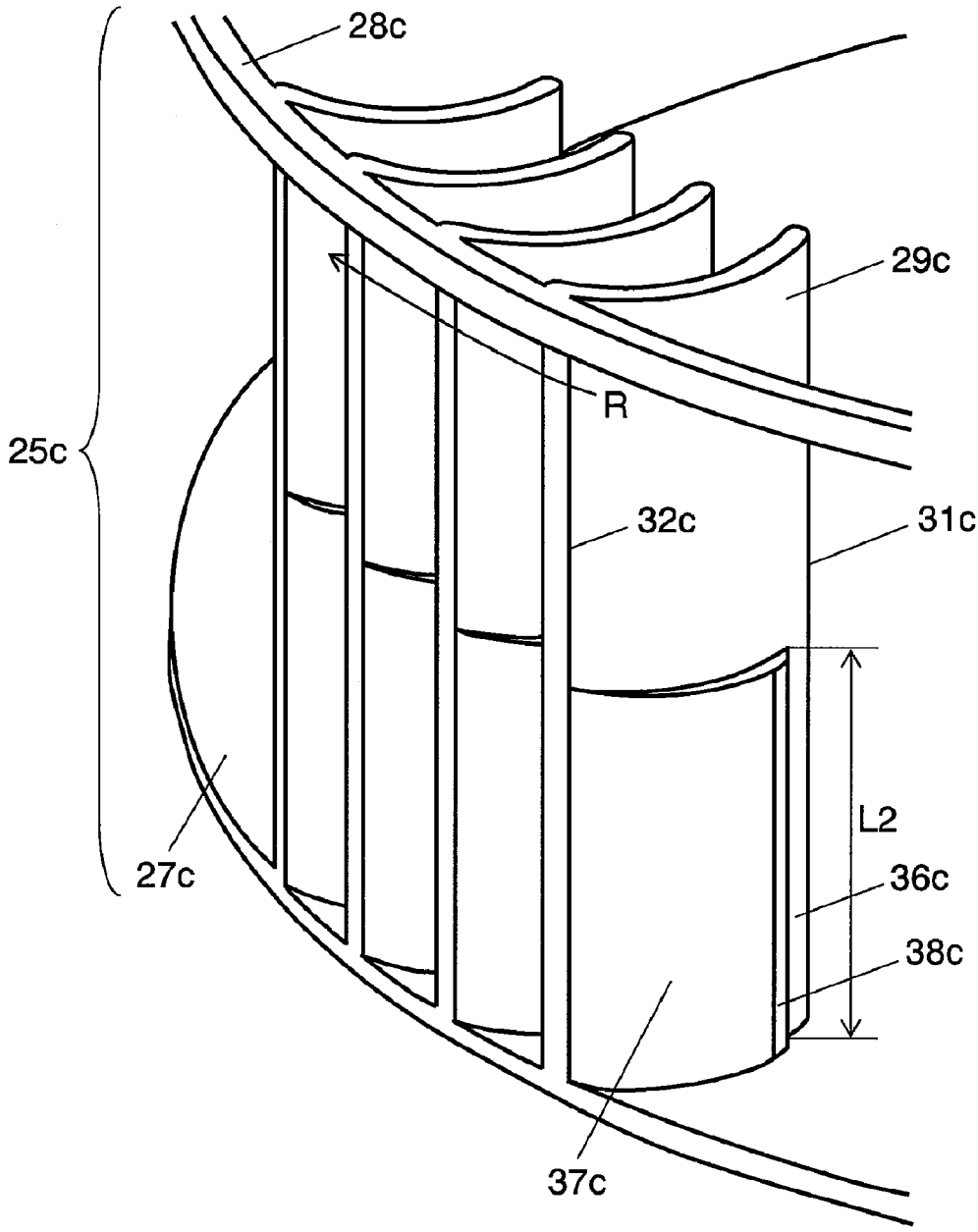
FIG. 5 shows a perspective view illustrating a main part of a multi-blade fan in accordance with a fourth embodiment of the present invention.

FIG. 5 shows a perspective view illustrating a main part of a multi-blade fan in accordance with the fourth embodiment of the present invention. Elements similar to those in the first through the third embodiments have the same reference marks, and the detailed descriptions thereof are omitted here.

As shown in FIG. 5, impeller 25*c* includes a number of blades 29*c* supported by main plate 27*c* and lateral plate 28*c* at both the axial ends of each one of blades 29*c*, which are formed in a given shape axially within given length L2 from main plate 27*c*. Length L2 falls within a range from not shorter than 1/3 to not longer than 2/3 of the entire axial length of blade 29*c*.

The given shape within given length L2 is similar to that of the second embodiment; a contour of the back face includes thin-walled section 36*c* and thick-walled section 37*c* from leading edge 31*c* to trailing edge 32*c*. Thick-walled section 37*c* gradually becomes thinner toward trailing edge 32*c*, and the thickness of trailing edge 32*c* is about a half of the thickness around junction 38*c*.

The thickness of thin-walled section 36*c* is not less than 1/10 of the max. thickness of thick-walled section 37*c* and not greater than 1/2 thereof. The length of thin-walled section 36*c* is not shorter than 1/20 and not longer than 1/3 of the chord length. Junction 38*c* between thin-walled section 36*c* and thick-walled section 37*c* shapes like an arc, and the length of junction 38*c* is not shorter than 1/20 and not longer than 1/10 of the chord length. The arc-shaped junction 38*c* preferably has a contour that assists section 36*c* to change rather sharply over to section 37*c*.

The foregoing shape of blade 29*c* allows suppressing the separation of airflow from main plate 27*c* when the airflow gathers on main plate 27*c*, i.e. at a greater airflow volume time, and allows the airflow to flow smoothly toward trailing edge 32*c*. The reason why thick-walled section 37*c* is placed at a distance from leading edge 31*c* is that the separation vortices occur at a place some few distance away from leading edge 31*c*. If the thickness of thick-walled section 37*c* is too thick, intervals between adjacent blades become smaller, while if it is too thin, the expected advantage cannot be produced.

The foregoing structure allows the airflow around the back face to flow along blade 29*c* efficiently, and the separation vortices can be further suppressed, thus the noise generated by the impeller can be lowered.

Embodiment 5

Figure 6:
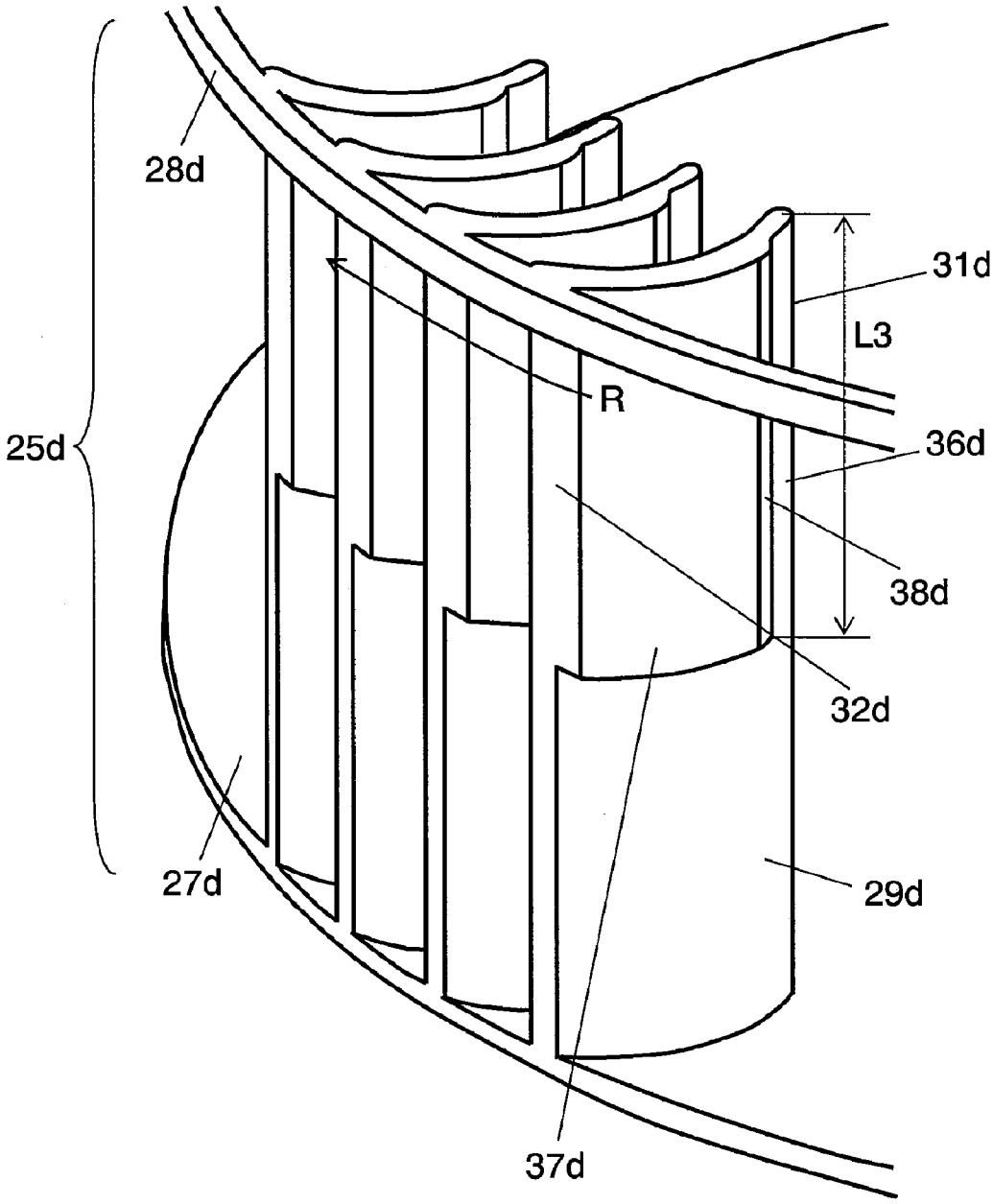
FIG. 6 shows a perspective view illustrating a main part of a multi-blade fan in accordance with a fifth embodiment of the present invention.

FIG. 6 shows a perspective view illustrating a main part of a multi-blade fan in accordance with the fifth embodiment of the present invention. Elements similar to those in the first through the fourth embodiments have the same reference marks, and the detailed descriptions thereof are omitted here.

As shown in FIG. 6, impeller 25*d* includes a number of blades 29*d* supported by main plate 27*d* and lateral plate 28*d* at both the axial ends of each one of blades 29*d*, which are formed in a given shape within given length L3 axially from lateral plate 28*d*. Length L3 falls within a range from not shorter than 1/3 to not longer than 2/3 of the entire axial length of blade 29*d*.

The given shape within given length L3 is similar to that of the first embodiment; a contour of the back face includes thin-walled section 36*d* and thick-walled section 37*d* from leading edge 31*d* to trailing edge 32*d*. The thickness of thin-walled section 36*d* is not less than 1/10 that of thick-walled section 37*d* and not greater than 1/2 thereof. The length of thin-walled section 36*d* is not shorter than 1/20 and not longer than 1/3 of the chord length. Junction 38*d* between thin-walled section 36*d* and thick-walled section 37*d* shapes like an arc, and the length of junction 38*d* is not shorter than 1/20 and not longer than 1/10 of the chord length. The arc-shaped junction 38*d* preferably has a contour that assists section 36*d* to change rather sharply over to section 37*d*.

The foregoing shape of blade 29*d* allows suppressing the separation of airflow from lateral plate 28*d* when the airflow gathers on lateral plate 28*d*, i.e. at a lower airflow volume time, and allows the airflow to flow smoothly toward trailing edge 32*d*. The reason why thick-walled section 37*d* is placed at a distance from leading edge 31*d* is that the separation vortices occur at a place some few distance away from leading edge 31*d*. If the thickness of thick-walled section 37*d* is too thick, intervals between adjacent blades become smaller, while if it is too thin, the expected advantage cannot be produced.

When the airflow gathers on lateral plate 28*d*, i.e. at the low airflow volume time, the foregoing structure allows the airflow around the back face to flow along blade 29*d* efficiently, and the separation vortices can be suppressed, thus the noise generated by the impeller can be lowered.

Embodiment 6

Figure 7:
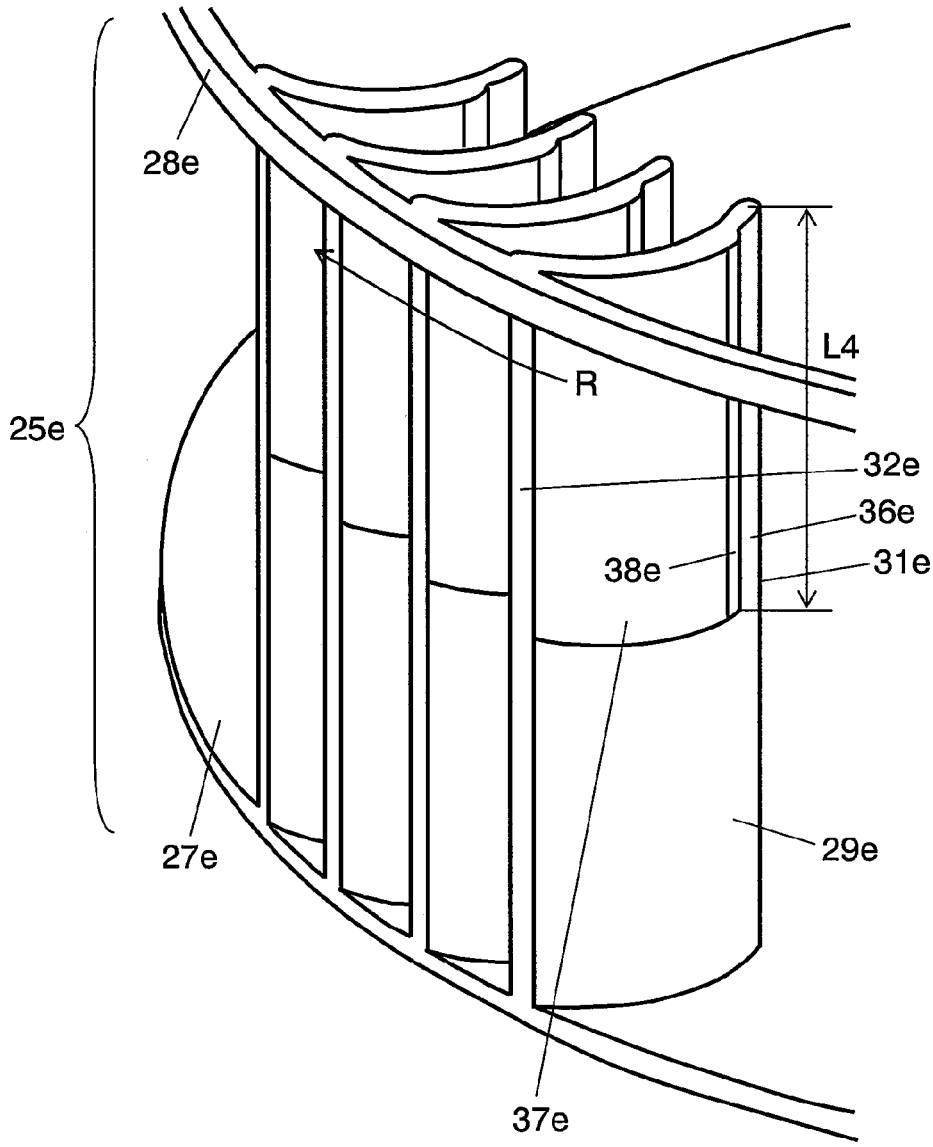
FIG. 7 shows a perspective view illustrating a main part of a multi-blade fan in accordance with a sixth embodiment of the present invention.

FIG. 7 shows a perspective view illustrating a main part of a multi-blade fan in accordance with the sixth embodiment of the present invention. Elements similar to those in the first through the fifth embodiments have the same reference marks, and the detailed descriptions thereof are omitted here.

As shown in FIG. 7, impeller 25*e* includes a number of blades 29*e* supported by main plate 27*e* and lateral plate 28*e* at both the axial ends of each one of blades 29*e*, which are formed in a given shape within given length L4 axially from lateral plate 28*e*. Length L4 falls within a range from not shorter than 1/3 to not longer than 2/3 of the entire axial length of blade 29*e*.

The given shape within given length L4 is similar to that of the second embodiment; a contour of the back face includes thin-walled section 36*e* and thick-walled section 37*e* from leading edge 31*e* to trailing edge 32*e*. Thick-walled section 37*e* gradually becomes thinner toward trailing edge 32*e*, and the thickness of trailing edge 32*e* is about a half of the thickness around junction 38*e*.

The thickness of thin-walled section 36*e* is not less than 1/10 of the max. thickness of thick-walled section 37*e* and not greater than ½ thereof. The length of thin-walled section 36*e* is not shorter than 1/20 and not longer than ⅓ of the chord length. Junction 38*e* between thin-walled section 36*e* and thick-walled section 37*e* shapes like an arc, and the length of junction 38*e* is not shorter than 1/20 and not longer than 1/10 of the chord length. The arc-shaped junction 38*e* preferably has a contour that assists section 36*e* to change rather sharply over to section 37*e*.

The foregoing shape of blade 29*e* allows suppressing the separation of airflow from lateral plate 28*e* when the airflow gathers on lateral plate 28*e*, i.e. at a low airflow volume time, and allows the airflow to flow smoothly toward trailing edge 32*e*. The reason why thick-walled section 37*e* is placed at a distance from leading edge 31*e* is that the separation vortices occur at a place some few distance away from leading edge 31*e*. If the thickness of thick-walled section 37*e* is too thick, intervals between adjacent blades become smaller, while if it is too thin, the expected advantage cannot be produced.

When the airflow gathers on lateral plate 28*e*, i.e. at the low airflow volume time, the foregoing structure allows the airflow around the back face to flow along blade 29*e* efficiently, and the separation vortices can be further suppressed, thus the noise generated by the impeller can be lowered.

Embodiment 7

Figure 8:
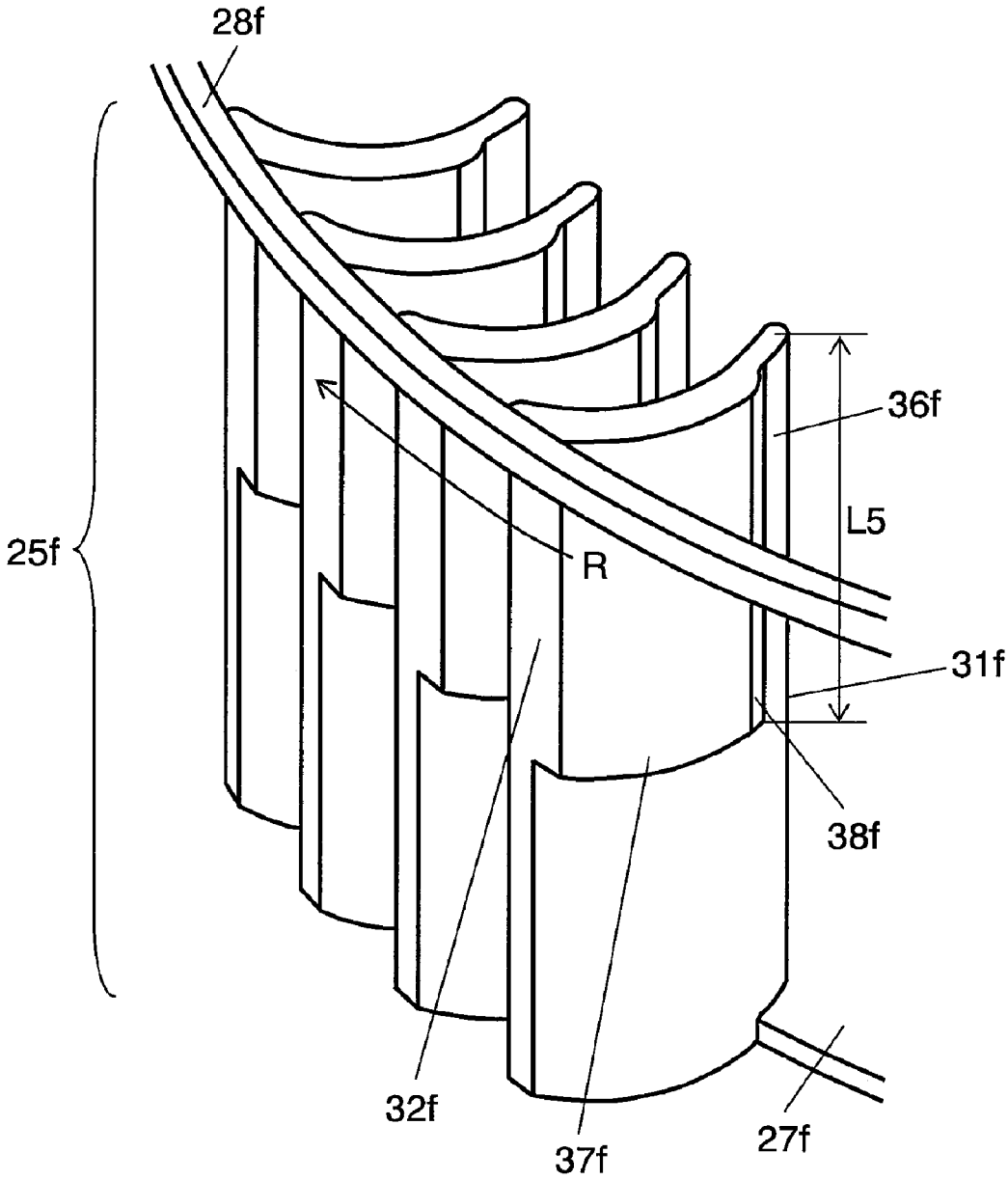
FIG. 8 shows a perspective view illustrating a main part of a multi-blade fan in accordance with a seventh embodiment of the present invention.

FIG. 8 shows a perspective view illustrating a main part of a multi-blade fan in accordance with the seventh embodiment of the present invention. Elements similar to those in the first through the sixth embodiments have the same reference marks, and the detailed descriptions thereof are omitted here.

As shown in FIG. 8, impeller 25*f* includes a number of blades 29*f* supported by main plate 27*f*, of which external shape is smaller than the main plates discussed previously, and lateral plate 28*f* at both the axial ends of each one of blades 29*f*, which are formed in a given shape within given length L5 axially from lateral plate 28*f*. Length L5 falls within a range from not shorter than ⅓ to not longer than ⅔ of the entire axial length of blade 29*f*.

The given shape within given length L5 is similar to that of the first embodiment; a contour of the back face includes thin-walled section 36*f* and thick-walled section 37*f* from leading edge 31*f* to trailing edge 32*f*. The thickness of thin-walled section 36*f* is not less than 1/10 that of thick-walled section 37*f* and not greater than ½ thereof. The length of thin-walled section 36*f* is not shorter than 1/20 and not longer than ⅓ of the chord length. Junction 38*f* between thin-walled section 36*f* and thick-walled section 37*f* shapes like an arc, and the length of junction 38*f* is not shorter than 1/20 and not longer than 1/10 of the chord length. The arc-shaped junction 38*f* preferably has a contour that assists section 36*f* to change rather sharply over to section 37*f*.

The foregoing shape of blade 29*f* allows suppressing the separation of airflow from lateral plate 28*f* when the airflow gathers on lateral plate 28*f*, i.e. at a low airflow volume time, and allows the airflow to flow smoothly toward trailing edge 32*f*. The reason why thick-walled section 37*f* is placed at a distance from leading edge 31*f* is that the separation vortices occur at a place some few distance away from leading edge 31*f*. If the thickness of thick-walled section 37*f* is too thick, intervals between adjacent blades become smaller, while if it is too thin, the expected advantage cannot be produced.

When the airflow gathers on lateral plate 28*f*, i.e. at the low airflow volume time, the foregoing structure allows the airflow around the back face to flow along blade 29*f* efficiently, and the separation vortices can be suppressed, thus the noise of the impeller can be lowered.

The seventh embodiment differs from the fifth embodiment in the diameter of main plate 27*f*, to be more specific, the diameter of main plate 27*f* is smaller than the diameter of thick-walled section 37*f*. This structure allows manufacturing impeller 25*f* made of resin in a unitary form. The unitary molding not only lowers the noise generated by the blades at the low airflow volume time but also reduces the cost of multi-blade fan.

Embodiment 8

Figure 9:
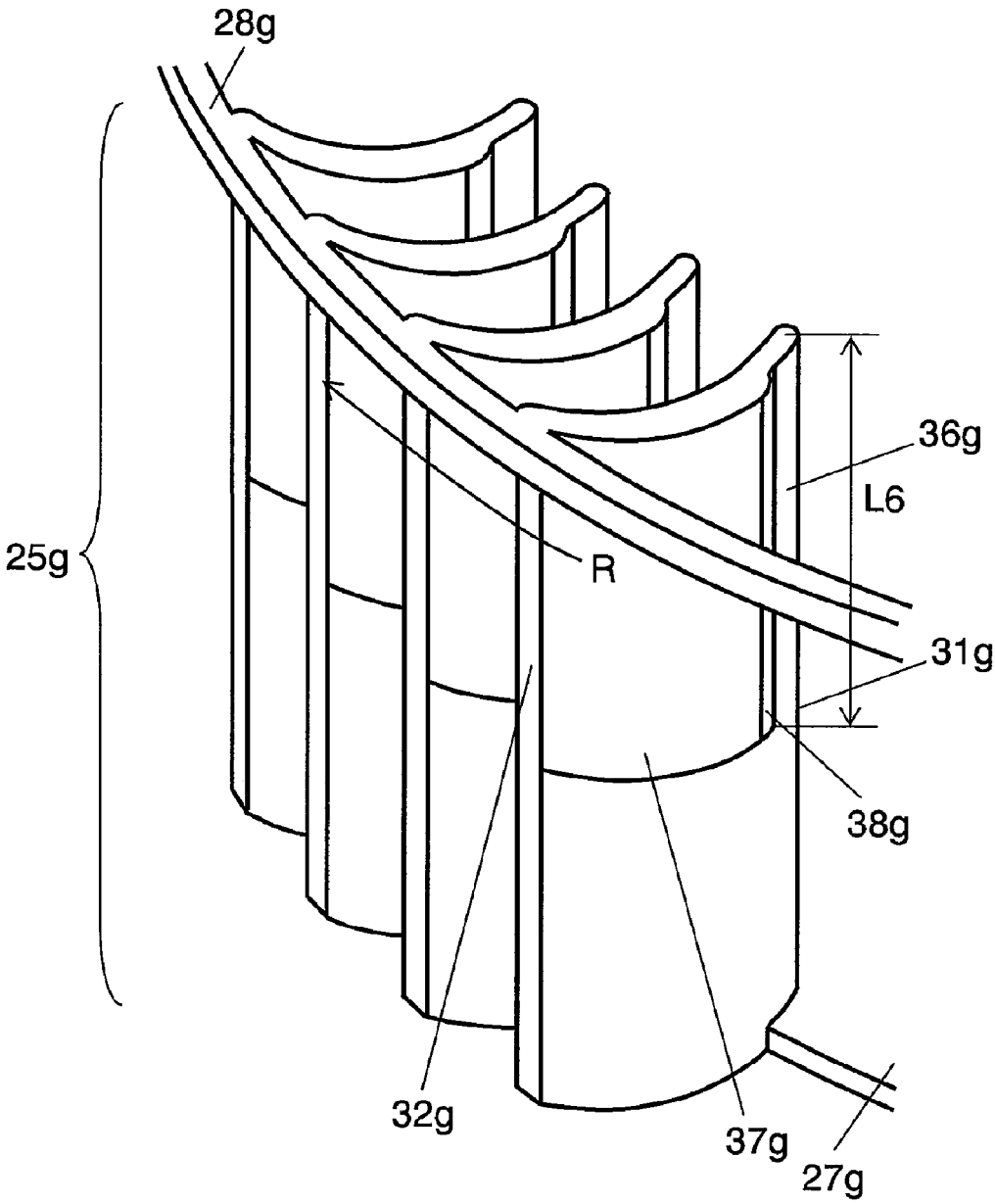
FIG. 9 shows a perspective view illustrating a main part of a multi-blade fan in accordance with an eighth embodiment of the present invention.

FIG. 9 shows a perspective view illustrating a main part of a multi-blade fan in accordance with the eighth embodiment of the present invention. Elements similar to those in the first through the seventh embodiments have the same reference marks, and the detailed descriptions thereof are omitted here.

As shown in FIG. 9, impeller 25*g* includes a number of blades 29*g* supported by main plate 27*g*, of which external shape is smaller than the main plates discussed above, and lateral plate 28*g* at both the axial ends of each one of blades 29*f*, which are formed in a given shape within given length L6 axially from lateral plate 28*g*. Length L6 falls within a range from not shorter than ⅓ to not longer than ⅔ of the entire axial length of blade 29*g*.

The given shape within given length L6 is similar to that of the second embodiment; a contour of the back face includes thin-walled section 36*g* and thick-walled section 37*g* from leading edge 31*g* to trailing edge 32*g*. Thick-walled section 37*g* gradually becomes thinner toward trailing edge 32*g*, and the thickness of trailing edge 32*g* is about a half of the thickness around junction 38*g*.

The thickness of thin-walled section 36*g* is not less than 1/10 of the max. thickness of thick-walled section 37*g* and not greater than ½ thereof. The length of thin-walled section 36*g* is not shorter than 1/20 and not longer than ⅓ of the chord length. Junction 38*g* between thin-walled section 36*g* and thick-walled section 37*g* shapes like an arc, and the length of junction 38*g* is not shorter than 1/20 and not longer than 1/10 of the chord length. The arc-shaped junction 38*g* preferably has a contour that assists section 36*e* to change rather sharply over to section 37*g*.

The foregoing shape of blade 29*g* allows suppressing the separation of airflow from lateral plate 28*g* when the airflow gathers on lateral plate 28*g*, i.e. at a low airflow volume time, and allows the airflow to flow smoothly toward trailing edge 32*g*. The reason why thick-walled section 37*g* is placed at a distance from leading edge 31*g* is that the separation vortices occur at a place some few distance away from leading edge 31*g*. If the thickness of thick-walled section 37*g* is too thick, intervals between adjacent blades become smaller, while if it is too thin, the expected advantage cannot be produced.

When the airflow gathers on lateral plate 28*g*, i.e. at the low air-flow time, the foregoing structure allows the airflow around the back face to flow along blade 29*g* efficiently, and the separation vortices can be further suppressed, thus the noise generated by the impeller can be lowered.

The eighth embodiment differs from the sixth embodiment in the diameter of main plate 27*g*, to be more specific, the diameter of main plate 27*g* is smaller than the diameter of thick-walled section 37*g*. This structure allows manufacturing impeller 25*g* made of resin in a unitary form. The unitary molding not only lowers the noise generated by the blades at the low airflow volume time but also reduces the cost of multi-blade fan.

Embodiment 9

Figure 10:
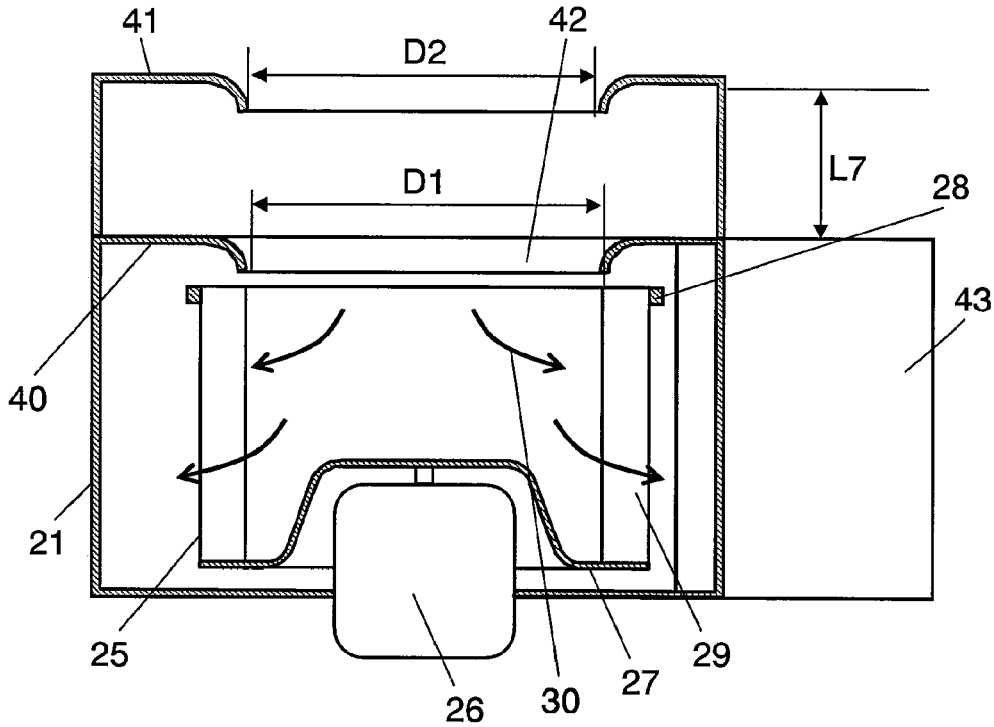
FIG. 10 shows a sectional view of a multi-blade fan in accordance with a ninth embodiment of the present invention.

FIG. 10 shows a sectional view illustrating a multi-blade fan in accordance with the ninth embodiment of the present invention. Elements similar to those in the first through the eighth embodiments have the same reference marks, and the detailed descriptions thereof are omitted here.

Spirally-shaped housing 21 has bell-mouth orifice 40 on the upper side at the center, sucking inlet 42 and exhausting outlet 43. Housing 21 includes impeller 25 therein, which is driven by motor 26. Impeller 25 has a number of blades 29 supported by main plate 27 and lateral plate 28 at both the axial ends of respective blades. Air sucked from inlet 42 works as inflow stream 30 and guides the air supplied to impeller 25 along the arrow marks shown in FIG. 10.

In this ninth embodiment, second orifice 41 is added to outside of first orifice 40, and diameter D1 of first orifice 40 and that of second orifice 41 are the same. Interval L7 between these two orifices is not smaller than 1/10 of diameter D1 or D2 and not greater than 1/2 of the diameter.

The noise generated by impeller 25 is radiated from the center of first orifice 40 toward sucking inlet 42; however, the noise radiated outside is cut off by second orifice 41 and attenuated between the two orifices due to resonance, so that the noise radiated outside is lowered. If interval L7 between the two orifices is too short, noise reduction effect becomes smaller, and if interval L7 is too long, the effect reaches the max. at a certain length, however; interval L7 exceeding that certain length, the effect starts lowering, and a device including this fan becomes bulky. The preceding range is thus preferable. The foregoing structure allows lowering the noise radiated outside of the multi-blade fan.

Embodiment 10

Figure 11:
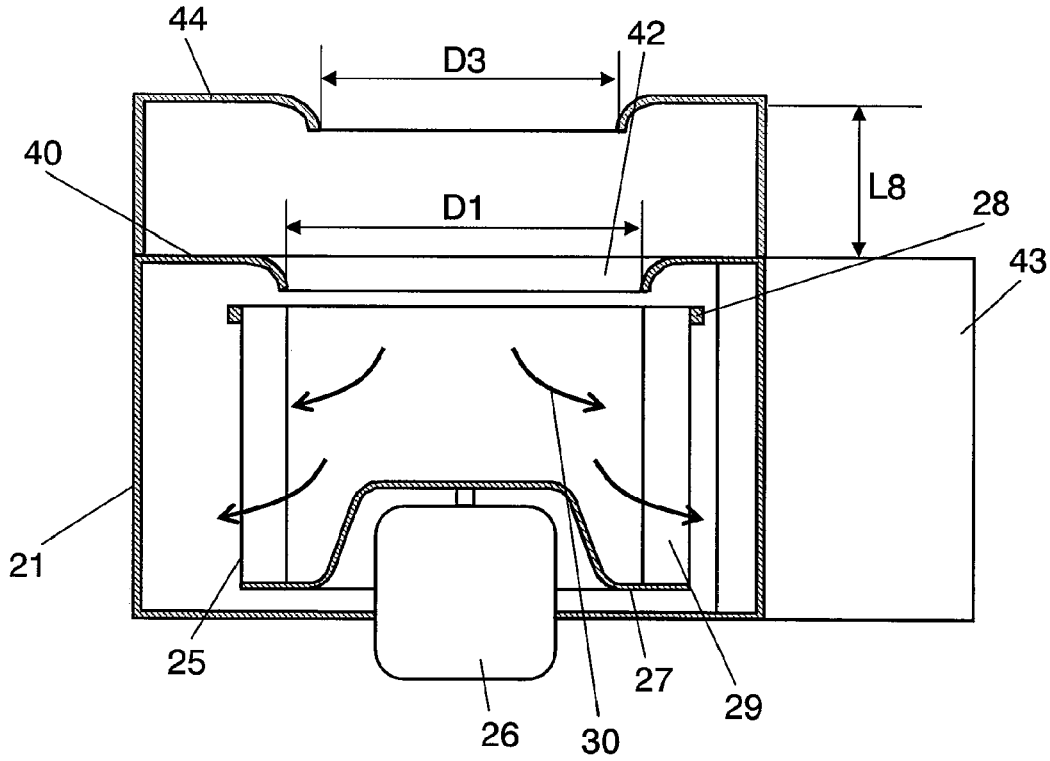
FIG. 11 shows a sectional view of a multi-blade fan in accordance with a tenth embodiment of the present invention.
Figure 12:
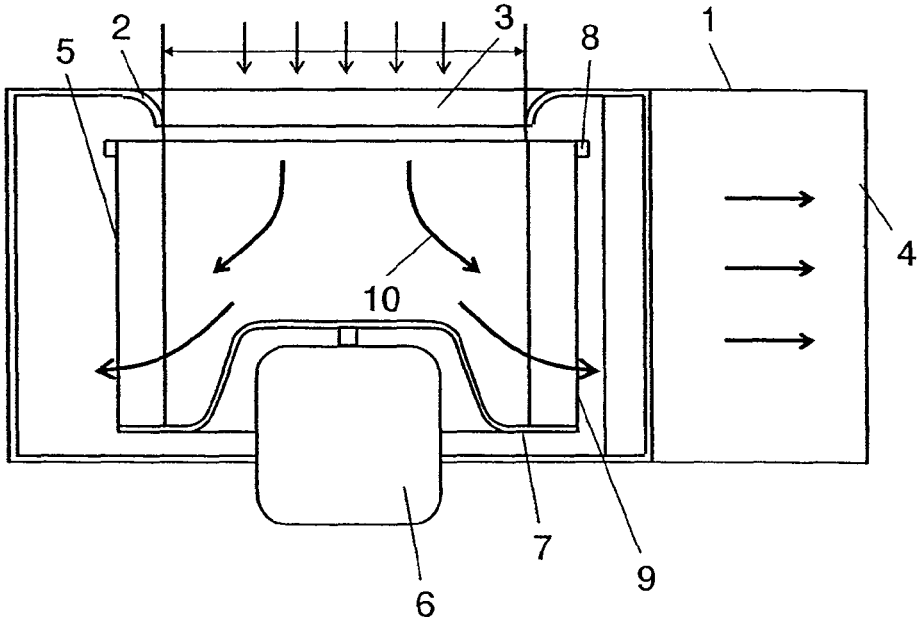
FIG. 12 PRIOR ART
FIG. 12 shows a general view of a conventional multi-blade fan.
Figure 13:
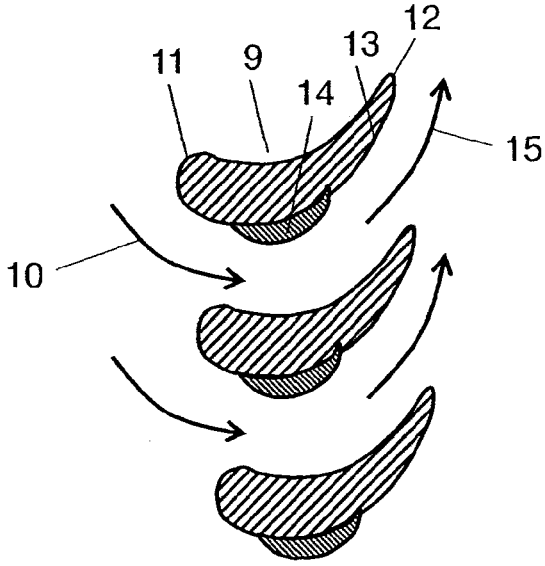
FIG. 13 PRIOR ART
FIG. 13 shows a sectional view cut along the vertical direction with respect to the rotary shaft of the blades of the conventional multi-blade fan shown in FIG. 12.

FIG. 11 shows a sectional view illustrating a multi-blade fan in accordance with the tenth embodiment of the present invention. Elements similar to those in the first through the ninth embodiments have the same reference marks, and the detailed descriptions thereof are omitted here.

The tenth embodiment differs from the ninth one in inner diameter D3 of second orifice 44. Inner diameter D3 is smaller than inner diameter D1 of first orifice 40 but not smaller than 2/3 of diameter D1. Interval L8 between first orifice 40 and second orifice 44 is not smaller than 1/10 of diameter D1 and not greater than 1/2 thereof.

The noise generated by impeller 25 is radiated from the center of first orifice 40 toward sucking inlet 42; however, the noise radiated outside is cut off by second orifice 44 and attenuated between the two orifices due to resonance, so that the noise radiated outside is lowered. Since inner diameter D3 of second orifice 44 is smaller than inner diameter D1 of first orifice 40, the radiated noise can be more effectively cut off, so that the noise radiated outside is further lowered. Greater noise-reduction effect can be expected at the smaller inner diameter D3 of second orifice 44; however, smaller inner diameter D3 will reduce an airflow volume, so that the preceding range of inner diameter D3 is optimum. The structure discussed above allows further lowering the noise radiated outside of the multi-blade fan.

Embodiment 11

The eleventh embodiment introduces a multi-blade fan in which one of the blade-shape oriented noise reduction structures described in first through eighth embodiments is combined with one of the orifice-oriented noise reduction structures described in the ninth and tenth embodiments. To be more specific, although a drawing of this multi-blade fan is omitted here, one of impellers 25, 25*a*, 25*b*, 25*c*, 25*d*, 25*e*, 25*f*, 25*g* is incorporated into the structure described in the ninth or the tenth embodiment.

This structure allows the airflow on the back face of the blades to flow along the blades, thereby suppressing the separation vortices, and yet, allows the second orifice to cut off the radiated noise, thereby further lowering the noise radiated outside effectively.

INDUSTRIAL APPLICABILITY

A multi-blade fan of the present invention includes an impeller formed of a number of blades, each one of which has a given shape of cross section cut along the direction vertical with respect to the rotary shaft of the impeller. The given shape allows a main air stream to flow along the back face of the blade. This structure allows suppressing separation vortices, and thus lowering the noise radiated outside.

The invention claimed is:

1. A multi-blade fan comprising:

a spiral shaped housing including a bell-mouth orifice at one side, a sucking inlet and an exhausting outlet;

an impeller disposed in the housing and including a plurality of blades supported by a main plate and a lateral plate at both axial ends of each one of the blades, said lateral plate located closer to the bell-mouth orifice than said main plate; and a motor for driving the impeller, wherein a cross section, cut along vertically with respect to a rotary shaft within a first given length, of each one of the blades has a given shape which allows a main air stream to flow along a back face of each one of the blades from a leading edge to a trailing edge of each one of the blades, wherein an axial length of each of the blades comprises a thin-walled section of a second given length and a thick-walled section of a third given length, said thick-walled section extending from said thin-walled section at a transition section so as to reach the trailing edge, the second given length being smaller than the third given length, a thickness of the thin-walled section being smaller than a thickness of the thick-walled section, said transition section oriented substantially perpendicular to the axial length of the blade.

2. The multi-blade fan of claim 1, wherein the first given length is an entire axial length of each one of the blades.

3. The multi-blade fan of claim 1, wherein the given shape includes a change such that the thin-walled section of the back face changes over to the thick-walled section from the leading edge to the trailing edge of each one of the blades.

4. The multi-blade fan of claim 3, wherein the second given length of the thin-walled section is not shorter than 1/20 and not greater than 1/3 of a chord length.

5. The multi-blade fan of claim 3, wherein a the thickness of the thin-walled section is not smaller than 1/10 and not greater than 1/2 of the thickness of the thick-walled section.

6. The multi-blade fan of claim 3, wherein a junction between the thin-walled section and the thick-walled section shapes like an arc, of which length is not shorter than 1/20 and not longer than 1/10 of a chord length.

7. The multi-blade fan of claim 3, wherein a thickness of the thick-walled section becomes thinner gradually toward the trailing edge.

8. The multi-blade fan of claim 3, wherein the main plate has a circumference smaller than a circumference of the trailing edge of the plurality of blades of the impeller.

9. The multi-blade fan of claim 3, wherein the change comprises a junction between the thin-walled section and the thick-walled section, said junction being substantially orthogonal to the transition section.

10. The multi-blade fan of claim 1, wherein the first given length is not shorter than ⅓ and not greater than ⅔ of the axial length of each one of the blades extending from the main plate.

11. The multi-blade fan of claim 1, wherein the first given length is not shorter than ⅓ and not greater than ⅔ of the axial length of each one of the blades extending from the lateral plate.

12. The multi-blade fan of claim 1, wherein the orifice is formed of a first orifice nearer to the impeller and a second orifice, and the two orifices are disposed with a given interval in between for cutting off sound.

13. The multi-blade fan of claim 12, wherein the first orifice has an inner diameter not shorter than 8/10 and not greater than 1/1 of an inner diameter of the impeller.

14. The multi-blade fan of claim 12, wherein the given interval is not shorter than 1/10 and not longer than ½ of an inner diameter of the first orifice.

15. The multi-blade fan of claim 12, wherein the second orifice has a contour identical to a contour of the first orifice.

16. The multi-blade fan of claim 12, wherein the second orifice has an inner diameter not smaller than ⅔ and not greater than 1/1 of an inner diameter of the first orifice.

* * * * *

UNITED STATES PATENT AND TRADEMARK OFFICE

CERTIFICATE OF CORRECTION

PATENT NO. : 7,744,350 B2
APPLICATION NO. : 11/574774
DATED : June 29, 2010
INVENTOR(S) : Ogino et al.

It is certified that error appears in the above-identified patent and that said Letters Patent is hereby corrected as shown below:

In column 10, line 58 of the Letters Patent, in claim 5 (Amendment claim 5), "wherein a the thickness" should read --wherein the thickness--.

Signed and Sealed this

Twenty-third Day of November, 2010

David J. Kappos

David J. Kappos
*Director of the United States Patent and Trademark Office*